US006089913A

United States Patent [19]

Holliday

[11] Patent Number: 6,089,913

[45] Date of Patent: Jul. 18, 2000

[54] END CONNECTOR AND CRIMPING TOOL FOR COAXIAL CABLE

[76] Inventor: Randall A. Holliday, 11047 Tennyson Pl., Westminster, Colo. 80030

[21] Appl. No.: 09/150,154

[22] Filed: Sep. 9, 1998

Related U.S. Application Data

[63] Continuation-in-part of application No. 08/747,539, Nov. 12, 1996, Pat. No. 5,863,220.

[51] Int. Cl.[7] ..... H01R 9/05

[52] U.S. Cl. ..... 439/584; 439/462

[58] Field of Search ..... 439/584, 578, 439/583, 585, 320, 321, 461, 462

[56] References Cited

U.S. PATENT DOCUMENTS

| | | | |
|---|---|---|---|
| 4,655,159 | 4/1987 | McMills | 439/584 |
| 5,392,508 | 2/1995 | Holliday et al. | 29/751 |
| 5,501,616 | 3/1996 | Holliday | 439/585 |
| 5,586,910 | 12/1996 | Del Negro et al. | 439/584 |
| 5,743,131 | 4/1998 | Holliday et al. | 72/409.1 |
| 5,899,769 | 5/1999 | Kohetschny et al. | 439/578 |

FOREIGN PATENT DOCUMENTS

| | | | |
|---|---|---|---|
| 3211008 | 10/1983 | Germany | 439/578 |
| 2249433 | 5/1992 | United Kingdom | 439/578 |
| 2277207 | 10/1994 | United Kingdom | 439/578 |

*Primary Examiner*—Gary F. Paumen
*Assistant Examiner*—Tho D. Ta
*Attorney, Agent, or Firm*—John E. Reilly

[57] ABSTRACT

A fitting for connecting a coaxial cable to a terminal or to another coaxial cable is made up of a connector body, an outer sleeve extending from one end of the connector body for insertion of an end of the cable, and a crimping member is loosely connected to the outer sleeve and has a tapered annular portion which in response to engagement by a compression tool will undergo axial movement with respect to the outer sleeve member and impart inward radial deformation to the outer sleeve member into sealed engagement with an external surface of the cable. In a modified form for splicing two cables together, the connector body is provided with outer sleeve members at opposite ends into which the ends of the coaxial cables are inserted and crimping members for crimping both of the sleeve members into sealed engagement with each of the respective cables.

23 Claims, 4 Drawing Sheets

END CONNECTOR AND CRIMPING TOOL FOR COAXIAL CABLE

CROSS REFERENCE TO RELATED APPLICATIONS

This application is a continuation-in-part of Ser. No. 08/747,539, filed Nov. 12, 1996, now U.S. Pat. No. 5,863,220 for the END CONNECTOR FITTING WITH CRIMPING DEVICE by Randall A. Holliday.

BACKGROUND AND FIELD OF INVENTION

This invention relates to end connectors or splices for cables; and more particularly relates to a novel and improved fitting for mechanically and electrically connecting a coaxial cable either to a terminal or to another coaxial cable with a crimping device carried on the fitting.

I have previously devised end connectors which are capable of effecting sealed engagement with one end of a coaxial cable and which are characterized by having a generally cylindrical crimping surface or sleeve for engagement by a crimping tool which uniformly reduces the diameter of the sleeve into a generally conical configuration snugly engaging the end of the cable, reference being made to U.S. Pat. Nos. 5,392,508 and 5,501,616.

Crimping tools and end connector fittings of the type disclosed in the above referenced patents are primarily intended for use by professional cable installers. However, there are many situations in which it is not economically feasible to purchase a professional quality crimping tool.

I previously devised an end connector which includes a threadedly attached crimping device to crimp the connector onto the end of a cable without the assistance of a professional quality crimping tool, reference being made to hereinbefore referred to U.S. patent application Ser. No. 08/747,539. Although such a solution is ideal for typical home users who will crimp only a small number of cable ends and do not want to incur the costs of a specialized crimping tool, the increased cost of such threaded end connectors and the threaded crimping devices are prohibitive and thus not suitable for those users who crimp coaxial cable on a more regular basis.

Accordingly, there is a need for a cable crimping system which utilizes an end connector incorporating a pre-installed crimping device actuated by a relatively simple and inexpensive crimping tool to achieve the necessary sealed engagement between the end connector and the end of the coaxial cable. Such a system would strike a balance between an expensive, professional quality crimping tool which crimps conventional end connectors, and the relatively expensive threaded end connectors which utilize threaded crimping devices in lieu of a separate crimping tool.

SUMMARY OF INVENTION

It is therefore an object of the present invention to provide for a novel and improved end connector with self-contained crimping device for crimping onto the end of a cable for the purpose of electrically connecting the cable to a terminal or to another coaxial cable.

Another object of the present invention is to provide for a novel and improved end connector with pre-installed crimping ring thereon which can be actuated by a compression-type crimping tool to effect sealed engagement between the end connector and the end of a coaxial cable; and specifically wherein the crimping tool is capable of being utilized either for crimping the cable to a terminal or post or to another coaxial cable.

It is a further object of the present invention to provide for a novel and improved end connector or fitting with self-contained crimping ring which is capable of effecting water-tight engagement between the end connector and end of a coaxial cable in a highly efficient and reliable manner.

In accordance with the present invention, a fitting has been devised for connecting a cable having an electrically conductive member to a second electrically conductive member and which is comprised of a connector body, an outer sleeve member extending from one end of the connector body which is sized for insertion of an end of a cable therethrough, and a crimping member having a tapered annular portion extending from a first diameter at least as great as a diameter of the outer sleeve to a second diameter less than the diameter of the outer sleeve and wherein axial movement of the crimping member along an outer surface of the outer sleeve member will cause the tapered annular portion to contract; i.e., impart inward radial deformation to the outer sleeve member into sealed engagement with an external surface of the cable. The crimping member is characterized in particular by having a main body portion composed of a plastic material of limited compressibility and surrounded by an outer metal reinforcing band, and the crimping ring is pre-installed to the outer sleeve so as to be readily engageable by a compression tool for imparting axial movement to said crimping ring with respect to the outer sleeve member.

The above and other objects, advantages and features of the present invention will become ore readily appreciated and understood from a consideration of the following detailed description of preferred and modified forms of the present invention when taken together with the accompanying drawings in which:

DETAILED DESCRIPTION OF THE PREFERRED EMBODIMENT

Figure 1:
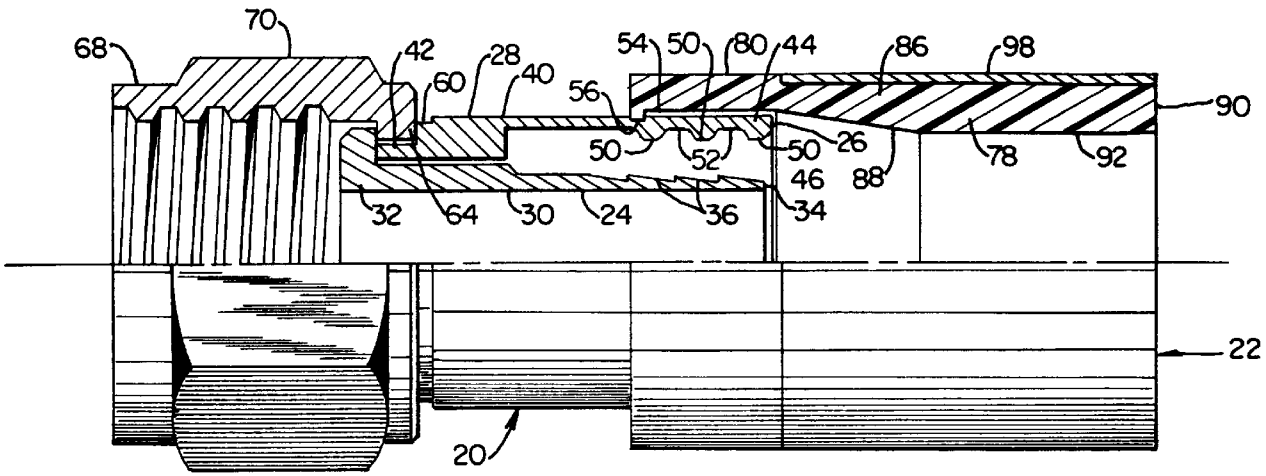
FIG. 1 is a partial sectional view of a preferred form of an end connector with a pre-installed crimping ring at one end thereof in accordance with the present invention.
Figure 2:
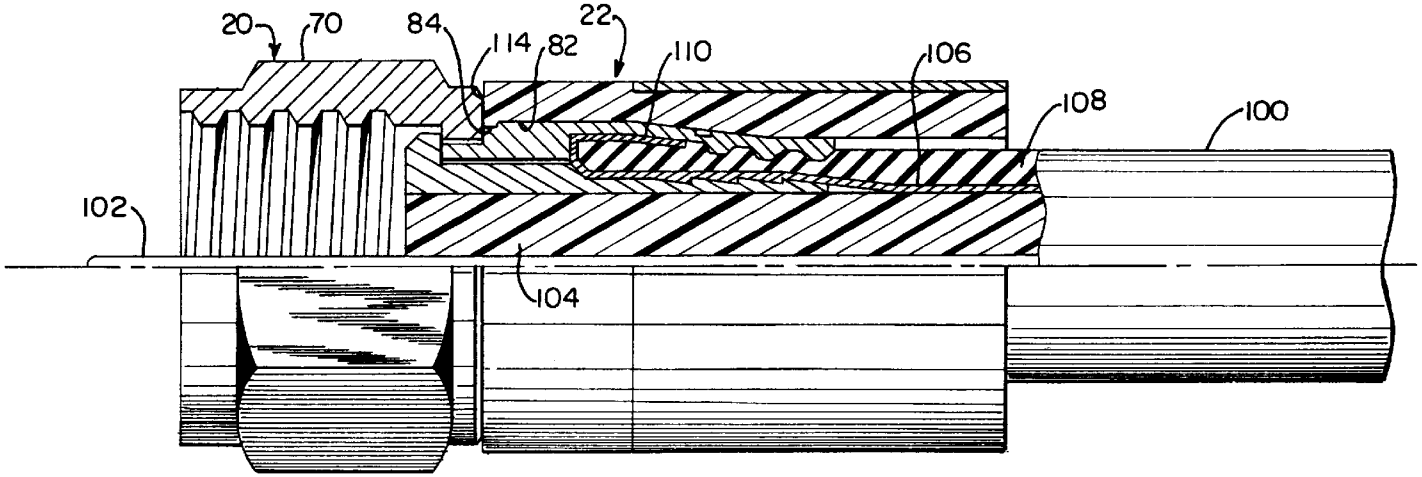
FIG. 2 is a partial section view of the preferred form of invention shown in FIG. 1 illustrating the end connector crimped to an end of a coaxial cable.

Referring in detail to the drawings, there is illustrated in FIGS. 1 and 2 a preferred form of an end connector 20 and a pre-installed crimping ring 22. The end connector 20 is constructed in a manner similar to that described in U.S. Pat. No. 5,501,616, the disclosure of which is hereby incorporated by reference, with significant modifications as described below.

The end connector 20 is broadly comprised of an inner sleeve 24 and a coaxial outer sleeve 26 extending to the rear of a fastener 28, the sleeves 24 and 26 as well as the fastener 28 typically being made from brass. The inner sleeve 24 includes a cylindrical body 30 having an enlarged shoulder 32 at a forward end, in addition to a trailing end 34 of reduced diameter and wall thickness in relation to the body 30. The trailing end 34 includes a plurality of serrations 36 formed on an exterior surface thereof, the serrations 36 being angled in a forward direction toward the fastener 28.

The outer sleeve 26 also includes a cylindrical body 40 in surrounding, coaxial relation to the body 30 of the inner sleeve 24, and further includes a forward end 42 which bears against the enlarged shoulder 32 of the inner sleeve 24. A trailing end 44 of the outer sleeve 26 is also of reduced diameter and thickness in relation to the body 40. The trailing end 44 is in spaced coaxial relation to the trailing end 34 of the inner sleeve 24 to form an annular space 46 therebetween. An interior surface 48 of the trailing end 44 includes a plurality of endless rings 50 extending circumferentially about a rearward end of the interior surface 48 in facing relation to the serrations 36 on the inner sleeve 24. The rings 50 are disposed at uniform, axially spaced intervals to define equidistant grooves 52 therebetween. An exterior surface 54 of the outer sleeve 26 is substantially smooth to facilitate crimping in a manner to be described. The exterior surface 54 includes a first groove 56 formed a predetermined distance from a rear end 58 of the outer sleeve 26. Additionally, a forward end of the exterior surface 54 includes a second groove or undercut portion 60, as shown in FIG. 1. The grooves 56 and 60 are described in greater detail below.

A rear end of the fastener 28 includes a radially inwardly directed flange 64 which is interposed between the enlarged shoulder 32 of the inner sleeve 24 and the cylindrical body 40 of the outer sleeve 26. An inner circumference of the fastener flange 64 loosely surrounds the end 42 of the outer sleeve 26 and enables rotation of the fastener 28 with respect to the inner and outer sleeves 24 and 26, respectively. A rear bearing surface of the flange 64 extends radially outwardly beyond the undercut portion 60 of the outer sleeve 26, for a purpose described in greater detail below. The fastener 28 includes an annular forward extension 68, and an interior surface of the fastener 28 is threaded for connecting the fastener 28 to a conventional threaded post, not shown, such as the terminal of a television set. An exterior surface of the fastener 28 includes a plurality of flats 70 to facilitate engagement of the fastener 28 by a hand tool such as a wrench.

The pre-installed crimping ring 22 functions in a manner similar to the threaded crimping device described in said patent application Ser. No. 08/747,539, although the present crimping ring 22 is not threaded for axial movement along the outer sleeve 26. Rather, a crimping tool 74 (FIGS. 3A and 3B) is utilized to axially displace the crimping ring 22 along the sleeve 26, as described in greater detail below.

FIG. 1 illustrates that the crimping ring 22 includes an annular body 78 preferably composed of a low-frictional material having limited compressibility, such as, Delrin®, Nylon® or a similar hard plastic material. A forward portion 80 of the body 78 is cylindrical and relatively thin-walled, having an internal diameter substantially equal to an external diameter of the outer sleeve 26. Additionally, an interior surface 82 of the forward portion 80 is slightly undercut up to a rib 84 at the leading end so that the rib 84 extends radially inwardly with respect to the remainder of the interior surface 82. The width of the rib 84 is substantially equal to the width of each of the grooves 56 and 60 on the outer sleeve 26. Extending to the rear of the forward portion 80, the body 78 thickens gradually to form an annular, intermediate portion 86 having a radially tapered interior surface 88. The intermediate portion 86 transitions to a cylindrical, rear portion 90 having a straight interior surface 92.

An exterior surface of the annular ring body 78 is preferably slightly undercut from a point just to the rear of the forward portion 80 and extending to a rear end 94 of the ring body 78. A reinforcing band 98, preferably made from brass, closely fits over the undercut portion of the ring body 78 from the rear end 94. The metal band 98 has an external diameter which is substantially equal to an external diameter of the forward portion 80 of the ring body 78 so that a forward end of the metal band 98 mates with the forward portion 80 in a flush manner.

The forward portion 80 of the crimping ring 22 fits over the rear end 58 of the outer sleeve 26 and slides forwardly over the smooth exterior surface 54 of the outer sleeve 26 until the leading end 84 engages the first groove 56, as shown in FIG. 1. Positioned in this manner, a leading edge of the tapered surface 88 is aligned with the rear end 58 of the outer sleeve 26 so that further axial movement of the crimping ring 22 forward toward the fastener 28 will tend to radially compress the outer sleeve 26. When the end connector 20 and crimping ring 22 are initially connected as described above, they are ready to receive an end of a coaxial cable 100 which has been prepared as described below.

The cable 100 is conventional in construction and comprises an inner conductor 102, a dielectric insulator 104, an outer braided conductor 106, and a dielectric outer jacket 108 preferably made from rubber or a similar material. Prior to inserting the end of the cable 100 into the end connector 20, the cable end is prepared by removing a first length of the outer jacket 108 from the cable end and then removing a second length of the braided conductor 106 and the dielectric insulator 104 from the cable end to expose an end of the inner conductor 102, where the second length is shorter than the first length. A portion 110 of the braided conductor 106 which extends beyond the outer jacket 108 is preferably folded back over a forward end of the outer jacket 108, as shown in FIG. 2.

Once prepared as described above, the end of the cable 100 is inserted through the hollow interior of the crimping ring 22 and into the end connector 20, as shown in FIG. 2. The exposed inner conductor 102 and the dielectric insulator 104 extend through the inner sleeve 24 so that a forward end of the insulator 104 extends to the enlarged shoulder 32, while the end of the inner conductor 102 extends to at least the forward end 68 of the fastener 28, as shown in FIG. 2. The remaining portions of the cable 100 consisting of the braided conductor 106 and the outer jacket 108 extend through the annular space 46 between the trailing ends 34 and 44 of the inner and outer sleeves 24 and 26, respectively, until the folded over portion 110 of the conductor 106 abuts the rear end of the body 40 of the outer sleeve 26, as shown in FIG. 2. Once the cable 100 has been fully inserted through the crimping ring 22 and into the end connector 20, the combination of the end connector 20, the ring 22 and the cable 100 are preferably placed within the tool 74, as described in greater detail below, so that the tool 74 may be operated to slide the ring 22 forwardly over the connector 20 and crimp the outer sleeve 26 onto the cable 100.

The axial force applied by the crimping tool 74 to the ring 22 is sufficient to force the leading end 84 of the ring 22 from the first groove 56 and drive the ring 22 forwardly over the outer sleeve 26. This forward axial motion of the ring 22 causes the tapered surface 88 to radially compress or contract the relatively thin-walled trailing end 44 of the outer sleeve 26 about the outer jacket 108 of the cable 100. The resilient material of the outer jacket 108 thus fills the grooves 52 between the endless rings 50 on the interior surface of the outer sleeve 26, effectively forming watertight O-ring seals between the jacket 108 and the rings 50 to prevent moisture or other contaminants from penetrating the annular space 46 and contacting the conductor 106. Additionally, the axially spaced rings 50 as well as the serrations 36 may be varied in dimension to accommodate different sized cables 100.

The crimping tool 74 continues to drive the ring 22 axially and forwardly until a forward end face 114 of the ring 22 contacts the bearing surface of the rear flange 64 of the fastener 28 and the leading end 84 of the ring 22 seats within the second groove 60, as shown in FIG. 2. Once the leading end 84 is secured within the annular groove 60, the end connector 20, the ring 22 and the crimped end of the cable 100 are removed from the tool 74. Additional details regarding the crimping tool 74 and its interaction with the end connector 20 and the pre-installed crimping ring 22 will now be described.

Figure 3A:
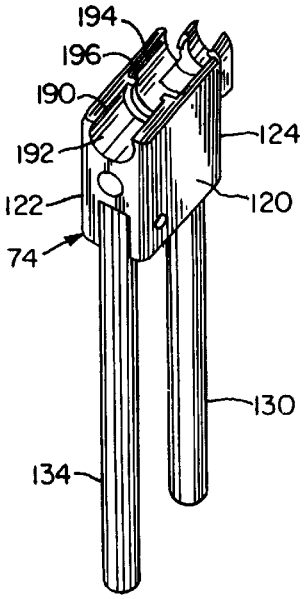
FIGS. 3A and 3B are perspective views of a crimping tool for crimping the end connector shown in FIG. 1 in accordance with the present invention.
Figure 3B:
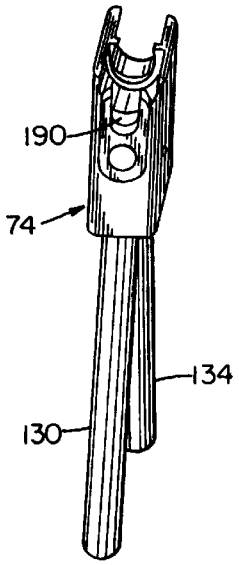
Figure 4:
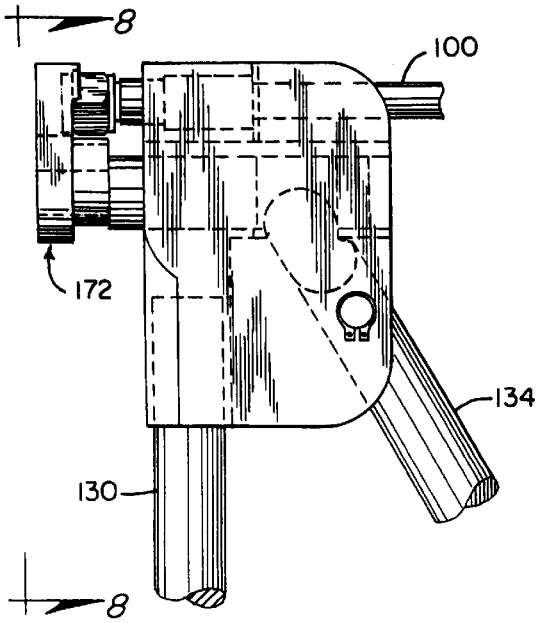
FIG. 4 is an enlarged side view in elevation of a portion of the crimping tool illustrated in FIGS. 3A and 3B, showing the tool in an extended position prior to crimping a coaxial cable to an end connector using a pre-installed crimping ring as shown in FIG. 1.
Figure 6:
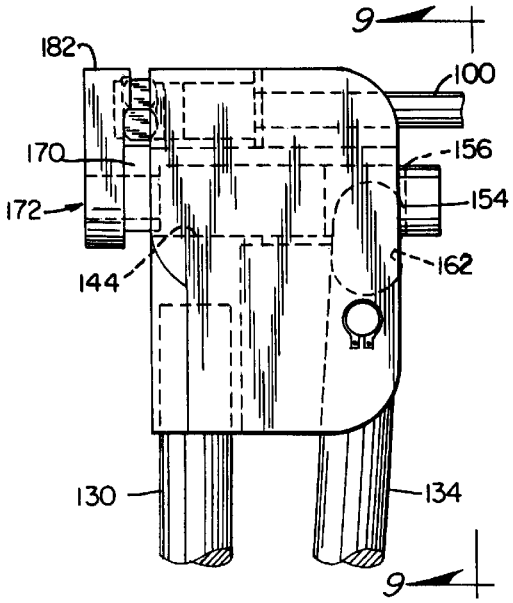
FIG. 6 is an enlarged side view in elevation similar to FIG. 4, showing the tool in a retracted position after sliding the pre-installed crimping ring over the end connector to crimp the coaxial cable.

The crimping tool 74, best shown in FIGS. 3A and 3B, broadly includes a body portion 120 preferably made from metal and having a substantially solid front end 122 and an open rear end 124. A first handle 130 is fixed within a socket 132 defined in the front end 122 of the tool 74. A second handle 134 is pivotally attached to the rear end 124 of the body portion 120 by a pivot pin 136 connected between the opposing faces 126. As shown in FIGS. 4 and 6, the handle 134 is free to pivot about the pin 136 within the open rear end 124.

A solid upper segment of the body portion 120 includes a cylindrical bore 144 traversing the upper end of the body 120. A slot 150 is preferably formed in the upper segment 138 directly beneath the cylindrical bore 144. A solid rod 154 preferably formed from brass, is disposed to slide back and forth within the bore 144, the rod 154 having an outer diameter substantially equal to an inner diameter of the bore 144. A vertical slot 156 is formed through a rear portion of the rod 154, as best shown in FIGS. 4 and 6, to receive a cam portion 162 at the end of the pivotal handle 134. Thus, pivoting the handle 134 away from the fixed handle 130 causes the cam portion 162 to force the rod 154 forwardly along the axis of the bore 144; or the handle 134 may be pivoted toward the fixed handle 130 to retract the cam portion 162, as shown in FIG. 4. The first position will hereafter be referred to as the extended position since it advances a front end of the rod 154 to a forward most position (FIG. 4) for loading the end connector 20 and crimping ring 22, as described below. Similarly, pivoting the handle 134 toward the fixed handle 130 causes the cam portion 162 to move the rod 154 axially toward the rear of the bore 144. This retracted position of the tool 74 will be described in greater detail below.

Figure 8:
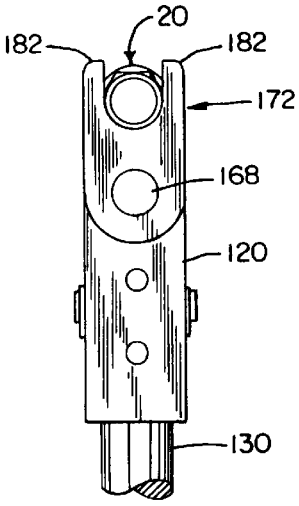
FIG. 8 is a front view in elevation of the tool taken along the line 8—8 in FIG. 4.
Figure 9:
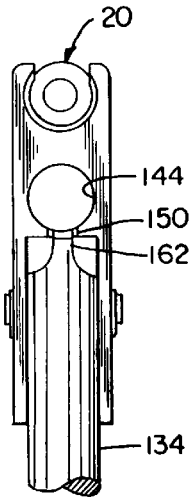
FIG. 9 is a rear view in elevation of the tool taken along the line 9—9 in FIG. 6.
Figure 10:
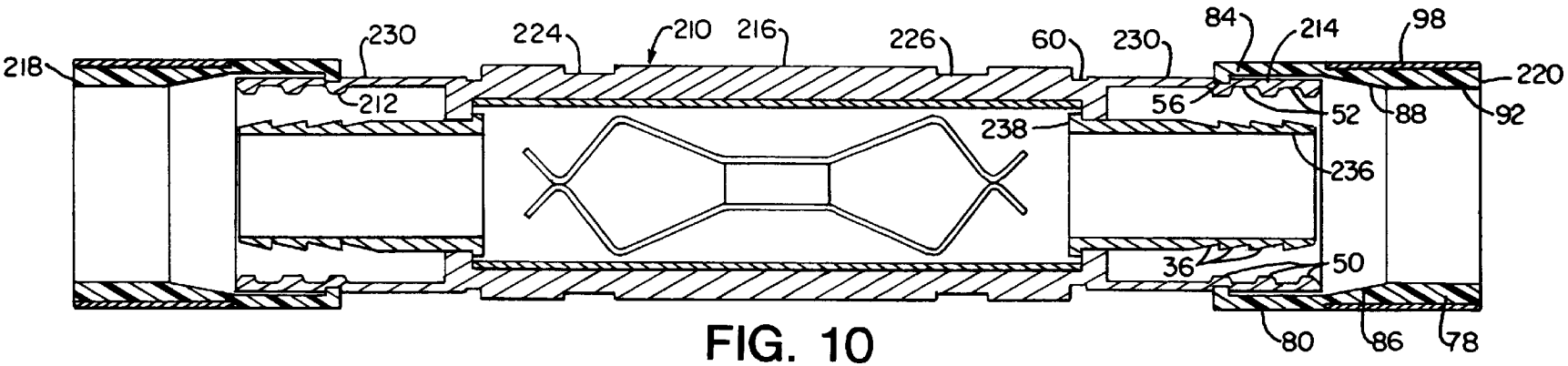
FIG. 10 is a partial sectional view of a modified form of the end connector shown in FIG. 1 utilized as a splice connector and having pre-installed crimping rings at opposite ends thereof in accordance with the present invention.

A cylindrical extension 168 projects forwardly from the front end 166 of the rod 154. The extension 168 is preferably of a diameter which is smaller than the diameter of the rod 154 and extends through holes formed within a connecting piece 170 and a push head 172, as best shown in FIGS. 4, 6 and 8. The connecting piece 170 is sized to fit within a cavity 174 formed within the front surface 148 of the upper segment 138 when the tool 74 is in the retracted position shown in FIG. 6. The push head 172 is preferably connected both to the extension 168 and the connecting piece 170 to move with the axial motion of the rod 154. The push head 172 is similar in shape but larger in size than the connecting piece 170 so that a periphery of the push head contacts the front surface 148 of the upper segment 138 when the connecting piece is withdrawn into the cavity 174. Thus, contact between the push head 172 and the front end surface of the body 120 prevents further rearward movement of the rod 154 when the tool 74 is in the retracted position shown in FIG. 6.

Figure 5:
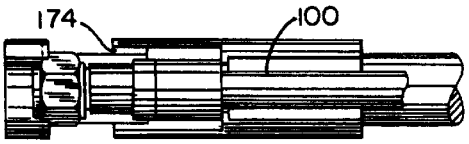
FIG. 5 is a top view of the extended tool, end connector, pre-installed crimping ring and coaxial cable shown in FIG. 4.
Figure 7:
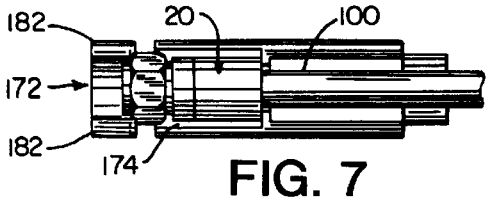
FIG. 7 is a top view of the retracted tool, end connector, pre-installed crimping ring and coaxial cable shown in FIG. 6.

An upper portion of the push head 172 is bifurcated to define a pair of curved extensions 182, the space between the extensions 182 being aligned with groove 190 and sufficient to allow the annular forward extension 68 of the fastener 28 to pass therethrough when the end connector 20 is loaded within the tool 74 as shown in FIGS. 4 and 5, while the extensions 182 engage the end surface of the flats 70 on the fastener 28.

A top portion of the solid upper segment 138 is preferably milled to form a semi-cylindrical groove 190, as shown in FIGS. 3A and 3B, which is separated into a forward groove segment 192 and a rear groove segment 194 by a flange 196 on the inner surface of the semi-cylindrical groove 190. The flange 196 defines a U-shaped opening which is sufficiently large to allow the coaxial cable 100 to pass therethrough, but is smaller than the diameter of the band 98 which covers the rear end of the crimping ring 22. Additionally, the flange 196 centers and captures a rear end of the band 98 when the end connector 20 and the crimping ring 22 are loaded within the tool 74 as shown in FIGS. 4 and 5.

Operation of the tool 74 begins by separating the handles 130 and 134 to move the push head 172 to its extended position ahead of the body 120. The combination of the end connector 20, the fastener 28, and the pre-installed crimping ring 22 are then loaded within the tool 74 together with the end of the cable 100 which has been prepared and fitted within the sleeves 24 and 26 of the end connector 20 as described above. The loading process includes placing the forward surface 186 of the flats 70 of the fastener 28 against the rear surface of the push head 172 while simultaneously placing the rear end of the band 98 against the flange 196. The flange 196 preferably contacts the end of the band 98 rather than the end of the ring body 78 because the band 98 provides greater strength in compression than the plastic ring body 78. The prepared end of the cable 100 is then loosely supported within the end connector 20 while the remaining length of the cable 100 is allowed to pass through the U-shaped opening 198 of the flange 196 and extend to the rear of the tool 74, as shown in FIGS. 4–7.

Once loaded as described above, the pivotal handle 134 is moved from its open or extended position shown in FIG. 4 to the closed or retracted position as shown in FIG. 6. Moving the handle 134 in this manner causes the extended push head 172 to retract against the tool body 120 as described above. Simultaneously, the fastener 28 and the attached end connector 20 are retracted toward the stationary crimping ring 22 so that the leading end 84 of the ring body 78 is forced out of the first groove 56. The outer sleeve 26 of the connector 20 then moves rearwardly through the crimping ring 22 and is compressed radially inwardly by the tapered surface 88 as described above. The rearward motion of the fastener 28 and the end connector 20 continues until the tool 74 reaches its fully retracted position (FIGS. 6 and 7) and the leading end 84 of the crimping ring 22 engages the second groove 60 within the exterior surface 54 of the outer sleeve 26.

During the operation of the tool 74, the curved extensions 182 extend around the periphery of the flats 70 to contain the fastener 28 and prevent the fastener 28 from slipping out of contact with the push head 172 as the push head 172 is retracted toward the tool body 120. Similarly, the flange 196 serves to contain the band 98 and prevent slippage between the band 98 and the flange 196. Smooth operation of the tool 74 is thus ensured by these retaining devices as well as by the metal-to-metal contact at both the forward push head 172 and the flange 196. Furthermore, the plastic ring body 78, preferably formed from Delrin®, defines a low-friction compressible surface portion for smooth movement of the crimping ring 22 axially along the outer sleeve 26, while the band 98 provides the necessary strength and rigidity to reinforce and prevent the intermediate portion 86 of the ring body 78 from bulging or warping as the outer sleeve 26 is crimped by the annular tapered surface 88.

Detailed Description of Modified Form of Invention

There is illustrated in FIGS. 10–13 a modified form of a splice connector 210 which includes opposite annular connecting ends 212 and 214 joined by a cylindrical, relatively thick-walled elongated body 216. A pair of crimping rings 218 and 220 are pre-installed at each end of the connecting ends 212 and 214, respectively, in a manner corresponding to the connection of the above-described crimping ring 22 to the end connector 20.

The elongated body 216 includes a generally cylindrical exterior surface 222 which defines left and right grooves 224 and 226, corresponding to the left and right connecting ends 212 and 214, respectively. Radially inwardly directed annular flanges 228 are provided at opposite ends of the body 216. Each connecting end 212 and 214 generally includes a thin-walled outer sleeve 230 formed from an axial extension of the body 216 which extends beyond the annular flange 228. Each outer sleeve 230 includes a set of endless rings 50 forming grooves 52 therebetween which are substantially identical to the rings 50 and grooves 52 of the end connector 20 described above. Each connecting end 212 and 214 further includes a separate inner sleeve 236 retained by an external shoulder 238 at one end to an inner surface of the radial flange 228 of the body 216. An external surface of the inner sleeve 236 includes a plurality of serrations 36 arranged in facing relation to the rings 50 in the same manner as the serrations 36 of the end connector 20 described above.

Figure 11:
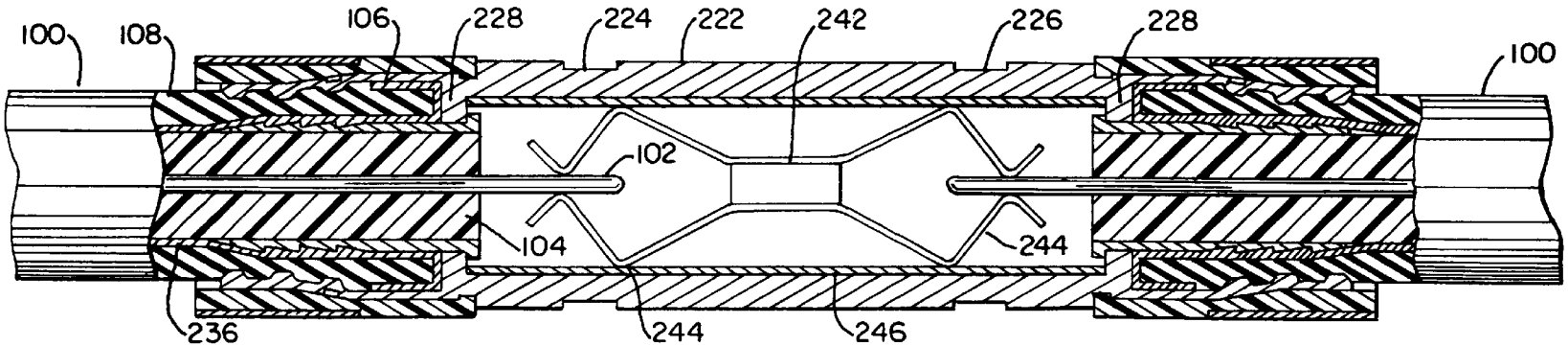
FIG. 11 is a partial section view of the splice connector shown in FIG. 10 illustrating two coaxial cables crimped to opposite ends thereof.

The ends of two separate coaxial cables 100 may be physically and electrically joined together using the splice connector 216 by inserting the ends into the opposing left and right connecting ends 212 and 214 as shown in FIG. 11. The cable ends are inserted substantially as described above with respect to the end connector 20, with the exposed inner conductor 102 and the dielectric insulating layer 104 extending through the inner sleeve 236, and the braided conductor 106 and the outer jacket 108 extending through the annular space between the inner and outer sleeves 236 and 230, respectively.

A hollow interior of the elongated body 216 extending between the opposing flanges 228 includes a jack 242 mounted therein. The jack 242 consists generally of two opposing pronged ends 244 mounted to establish electrical connection between the inner conductors 102 of two opposite coaxial cables 100, as shown in FIG. 11. An insulating liner 246 covers the hollow interior of the body 216 in outer concentric relation to the jack 242.

The left and right crimping rings 218 and 220 are identical to the crimping ring 22 described above with like parts correspondingly enumerated to those of FIG. 1. The leading ends 84 of each of the crimping rings 218 and 220 are initially retained within a first groove 56 formed on each of the outer sleeves 230 of the left and right connecting ends 212 and 214, respectively. When crimped by the tool 74, the leading ends 84 of the rings 218 and 220 are forced from their respective first grooves 56 and pushed axially along their respective outer sleeves 230 until each leading end 84 seats within a second groove 60 adjacent to the splice connector body 216. Each outer sleeve 230 is thus crimped against the outer jacket 108 of its corresponding cable 100 so that the endless rings 50 compress the rubber outer jacket 108 to fill the grooves 52, thereby forming a watertight O-ring seal between each outer sleeve 230 and its associated cable 100 as shown in FIG. 11. Crimping both ends 212 and 214 in this manner serves to physically connect the two cables 100 together. Additionally, the two cables 100 are electrically connected by the splice connector 210, with the inner conductors 102 being electrically connected by the jack 242 and the braided conductors 106 being electrically connected by the connector body 216 which is preferably made from brass. The insulating liner 246 surrounding the jack 242 prevents any interference or contamination between the two different electrical signals.

Figure 12:
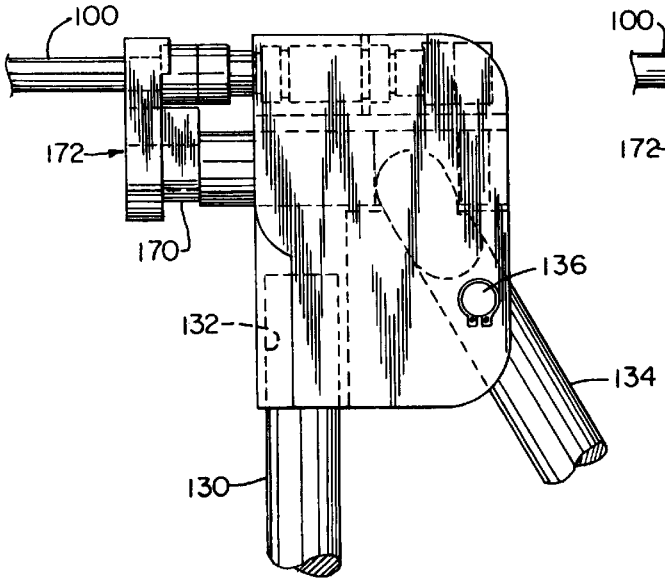
FIG. 12 is an enlarged side view in elevation of a portion of the crimping tool illustrated in FIGS. 3A and 3B, showing the tool in an extended position prior to crimping a coaxial cable to one end of the splice connector shown in FIG. 10.
Figure 13:
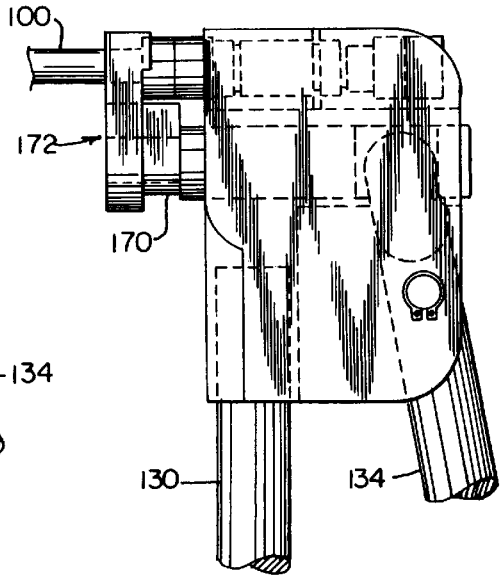
FIG. 13 is an enlarged side view in elevation similar to FIG. 12, showing the tool in a retracted position after sliding the pre-installed crimping ring over the one end of the splice connector to crimp the coaxial cable.

The crimping tool 74 crimps the left and right connecting ends 212 and 214 to the ends of their respective cables 100 in a manner similar to the end connector 20 shown in FIGS. 1–9. However, two crimping operations must be performed with the crimping tool 74, one for each connecting end 212 and 214. FIGS. 12 and 13 depict a crimping operation on the connecting end 212, the right crimping ring 220 previously having been crimped to the right connecting end 214.

FIG. 12 illustrates the tool 74 in its open or extended position with the push head 172 extended forwardly from the tool body 120. The splice connector 210 is preferably loaded within the groove 190 of the upper segment 138 of the tool 74 so that the rear end 204 of the band 98 on the left crimping ring 218 is positioned against the rear bearing surface of the push head 172. Simultaneously, the flange 196 is inserted within the left groove 224 of the connector body 216. The pivotal handle 134 is then squeezed toward the fixed handle 130 to advance the tool 74 from its extended position shown in FIG. 12 to its retracted position shown in FIG. 13. Retracting the extended push head 172 toward the tool body 120 thus forces the leading end 84 of the crimping ring 218 from the first groove 250 and moves the crimping ring 218 over the top of the outer sleeve 230 so that the tapered surface 88 of the crimping ring 218 radially compresses the outer sleeve 230 as described above. The rearward axial motion of the crimping ring 218 continues until the leading end 84 engages the second groove 60 at the end of the outer sleeve 230.

At this point, the crimping process on the left connecting end 212 is complete. The process for crimping the right crimping ring 220 to the right connecting end 214 is essentially identical to that for the left ring 218 and the left connecting end 212. Specifically, the splice connector 210 is turned around within the groove 190 of the tool 74 so that the rear end of the band 98 on the right crimping ring 220 is placed against the push head 172. Next, the flange 196 is inserted within the right groove 226 so that a rightmost radial wall of the groove 226 fits within the flange 196. In this manner, the same tool 74 can be used to crimp both ends 212 and 214 of the splice connector 210.

The crimping tool 74, the end connector 20 and the splice connector 210 thus provide a significant advantage over the related elements described in the above referenced patents since the tool 74 is relatively inexpensive in comparison to the professional quality crimping tools designed for use with more conventional end connectors, such as, the tool described in U.S. Pat. No. 5,743,131. Additionally, the end connector 20 and the splice connector 210 together with the pre-installed crimping rings 22 can be manufactured at a lower cost than the corresponding threaded connectors and threaded crimping devices described in said U.S. patent application Ser. No. 08/747,539.

It is therefore to be understood that the above and other modifications and changes may be readily made in the construction and arrangement of elements comprising the preferred and modified forms of invention without departing from the spirit and scope of the invention as defined by the appended claims and reasonable equivalents thereof.

I claim:

1. A fitting for connecting a cable having an electrically conductive member to a second electrically conductive member, said fitting comprising:

a connector body;

a thin-walled outer sleeve member extending from one end of the connector body, said sleeve member sized for insertion of an end of said cable therethrough; and a crimping member having a tapered annular portion extending from a first diameter at least as great as a diameter of said outer sleeve member to a second diameter less than the diameter of said outer sleeve member, wherein axial movement of said crimping member along an outer surface of said outer sleeve member causes said tapered annular portion to impart inward radial deformation to said outer sleeve member into sealed engagement with an external surface of said cable.

2. A fitting according to claim 1, wherein said crimping member includes an internal at one end thereof engageable with a first external groove at one end of said outer sleeve member and movable into engagement with a second external groove on said outer sleeve member in response to axial movement of said crimping member along said outer surface of said outer sleeve member.

3. A fitting according to claim 1, wherein said crimping member includes a cylindrical portion extending from an inner diameter of said tapered annular portion and having a diameter substantially equal to said second diameter.

4. A fitting according to claim 3, wherein said second diameter substantially corresponds to an outer diameter of said cable.

5. A fitting according to claim 1, wherein said crimping member includes a leading cylindrical portion extending forwardly of said tapered annular portion and having a diameter at least as great as said first diameter, said leading cylindrical portion slidable over said outer sleeve member.

6. A fitting according to claim 5, wherein said crimping member is composed of a plastic material of limited compressibility and an outer metal reinforcing band.

7. A fitting according to claim 1, wherein said means for axially advancing said crimping member with respect to said outer sleeve is defined by a compression tool having compression members movable toward and away from one another.

8. A fitting according to claim 7 wherein one of said compression members is engageable with said connector body and the other of said compression members is engageable with said crimping member.

9. A fitting according to claim 8 wherein said compression tool includes handle means for advancing said compression member between an extended position and a retracted position.

10. A fitting for electrically and mechanically connecting a coaxial cable having an electrically conductive member to a second electrically conductive member, said fitting comprising:

a connector body;

a thin-walled outer sleeve member of substantially uniform thickness extending from one end of the connector body, said sleeve member sized for insertion of an end of said cable therein; and a crimping member including a main body portion of limited compressibility and an outer thin-walled reinforcing band, said main body portion having a tapered annular portion extending from a first diameter greater than a diameter of said outer sleeve member to a second diameter less than the diameter of said outer sleeve member, and wherein axial movement of said crimping member along an outer surface of said outer sleeve member causes said main body portion to impart inward radial deformation to said outer sleeve member into sealed engagement with an external surface of said cable.

11. A fitting according to claim 10, wherein said main body portion includes a leading cylindrical portion extending forwardly of said tapered annular portion and having a diameter substantially equal to said first diameter, said leading cylindrical portion slidable over said outer sleeve member.

12. A fitting according to claim 10, wherein said crimping member includes an internal rib at one end thereof engageable with a first external groove at one end of said outer sleeve member and movable into engagement with a second external groove on said outer sleeve member in response to axial movement of said crimping member along said outer surface of said outer sleeve member.

13. A fitting according to claim 10, wherein said main body portion includes a cylindrical portion extending from an inner diameter of said tapered annular portion and having a diameter substantially equal to said second diameter.

14. A fitting according to claim 13, wherein said second diameter substantially corresponds to an outer diameter of said cable.

15. A fitting according to claim 10, wherein said main body portion is composed of a plastic material of limited compressibility and said reinforcing band is composed of metal.

16. A fitting according to claim 15, wherein means are provided for axially advancing said crimping member with respect to said outer sleeve.

17. In a fitting for connecting a coaxial cable having inner and outer electrically conductive portions to another electrically conductive portion and wherein said fitting is provided with a connector body having inner and outer concentric sleeve members at one end for insertion of said spaced electrically conductive portions, the improvement comprising:

a crimping member including a main body portion of limited compressibility and an outer reinforcing band, said main body portion having a tapered annular portion extending from a first diameter at least as great as the diameter of said outer sleeve member to a second diameter less than the diameter of said outer sleeve member, and an internal rib at one end of said crimping member engageable with a first external groove at one end of said outer sleeve member and movable into engagement with a second external groove on said outer sleeve member in response to axial movement of said crimping member along an outer surface of said outer sleeve member; and means for axially advancing said crimping member with respect to said outer sleeve.

18. In a fitting according to claim 17, wherein said crimping member includes a leading cylindrical portion extending forwardly of said tapered annular portion and having a diameter at least as great as said first diameter, said leading cylindrical portion slidable over said outer sleeve member.

19. In a fitting according to claim 17, wherein said crimping member includes a cylindrical portion extending from an inner diameter of said tapered annular portion and having a diameter substantially equal to said second diameter.

20. In a fitting according to claim 19, wherein said second diameter substantially corresponds to an outer diameter of said cable.

21. In a fitting according to claim 17, wherein said means for axially advancing said crimping member with respect to said outer sleeve is defined by a compression tool having compression members movable toward and away from one another.

22. In a fitting according to claim 21, wherein one of said compression members is engageable with said connector body and the other of said compression members is engageable with said crimping member.

23. In a fitting according to claim 22 wherein said compression tool includes handle means for advancing said compression member between an extended position and a retracted position.

* * * * *

UNITED STATES PATENT AND TRADEMARK OFFICE

CERTIFICATE OF CORRECTION

PATENT NO. : 6,089,913

DATED : 18 July, 2000

INVENTOR(S) : Holliday, R. A.

It is certified that error appears in the above-indentified patent and that said Letters Patent is hereby corrected as shown below:

| Column No. | Line No. | Correction |
|---|---|---|
| 2 | 29 | Cancel "ore"and substitute -- more -- |
| 9 | 65 | Claim 2<br>After "internal", insert -- rib -- |

Signed and Sealed this

Tenth Day of April, 2001

Nicholas P. Godici

*Attest:*

NICHOLAS P. GODICI

*Attesting Officer*

*Acting Director of the United States Patent and Trademark Office*